US010895042B2

(12) United States Patent
Romero

(10) Patent No.: US 10,895,042 B2
(45) Date of Patent: Jan. 19, 2021

(54) CONCRETE CROSSTIE

(71) Applicant: Gutanna Innovative Concrete and Technologies, LLC, San Antonio, TX (US)

(72) Inventor: Mauricio Javier Gutierrez Romero, San Pedro Garza Garcia (MX)

( * ) Notice: Subject to any disclaimer, the term of this patent is extended or adjusted under 35 U.S.C. 154(b) by 360 days.

(21) Appl. No.: 15/949,748

(22) Filed: Apr. 10, 2018

(65) Prior Publication Data

US 2019/0309483 A1 Oct. 10, 2019

(51) Int. Cl.

| | |
|---|---|
| ***E01B 3/34*** | (2006.01) |
| ***E01B 3/42*** | (2006.01) |
| ***E01B 3/40*** | (2006.01) |
| ***E01B 9/68*** | (2006.01) |

(52) U.S. Cl.

CPC ..... *E01B 3/34* (2013.01); *E01B 3/40* (2013.01); *E01B 3/42* (2013.01); *E01B 9/68* (2013.01); *E01B 2201/02* (2013.01)

(58) Field of Classification Search

CPC ..... E01B 3/28; E01B 3/34; E01B 3/32; E01B 3/40; E01B 3/42; E01B 9/68

USPC ..... 238/91

See application file for complete search history.

(56) References Cited

U.S. PATENT DOCUMENTS

| | | | | |
|---|---|---|---|---|
| 791,195 | A * | 5/1905 | Howell | E01B 3/32 238/91 |
| 5,110,046 | A * | 5/1992 | Young | E01B 9/68 238/283 |
| 9,238,891 | B1 * | 1/2016 | Romero | E01B 3/34 |
| 9,890,503 | B2 * | 2/2018 | Romero | E01B 3/34 |
| 2016/0002863 | A1 * | 1/2016 | Romero | E01B 3/32 238/85 |
| 2019/0211512 | A1 * | 7/2019 | Mattson | E01B 9/38 |
| 2019/0309483 | A1 * | 10/2019 | Romero | E01B 3/42 |

* cited by examiner

*Primary Examiner* — Zachary L Kuhfuss

(74) *Attorney, Agent, or Firm* — Jackson Walker LLP; Christopher J. Rourk

(57) ABSTRACT

A monoblock concrete crosstie for railway tracks that achieves a high performance in operation includes a steel structure that is formed from ultra-resistant high strength steel plates embedded in a concrete element and having pre-stressed cold rolled wires with ends that form button head knots which are anchored to the steel plates. The crosstie includes rail seats with a convex channeled formation that is mateable with an extending member of a faceplate wherein the railseat has a width less than the width of the faceplate, and a center of the face plate has a first distance from a center of the concrete element and a center of the rails seat has a second distance from the center of the concrete element, the first distance greater than the second distance.

20 Claims, 5 Drawing Sheets

CONCRETE CROSSTIE

RELATED APPLICATIONS

This application claims priority to and benefit of U.S. Provisional Patent Application 62/483,812, filed Apr. 10, 2017, entitled "Concrete Crosstie for Interspersing with Wood Crossties," which is hereby incorporated by reference for all purposes as if set forth herein in its entirety.

TECHNICAL FIELD

The present disclosure relates generally to crossties, and more specifically to a high strength, integrally pre-stressed monoblock concrete crosstie with optimal rail seat configuration for use with optimal rail fastening system configuration and in ballasted railway.

BACKGROUND

Crossties are used to support rails for rails ways, and have traditionally been made from wood or concrete.

SUMMARY

A monoblock concrete crosstie for railway tracks that achieves a high performance in operation includes a steel structure that is formed from ultra-resistant high strength steel plates embedded in a concrete element and having pre-stressed cold rolled wires with ends that form button head knots which are anchored to the steel plates. The crosstie includes rail seats each with a convex channeled formation that are mateable with an extending member of a tie faceplate of a rail fastening system wherein the rail seat has a width less than the width of the faceplate, and a center of the face plate has a first distance from a center of the concrete element and a center of the rails seat has a second distance from the center of the concrete element, the first distance greater than the second distance.

Other system, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF PREFERRED EMBODIMENTS

Figure 1:
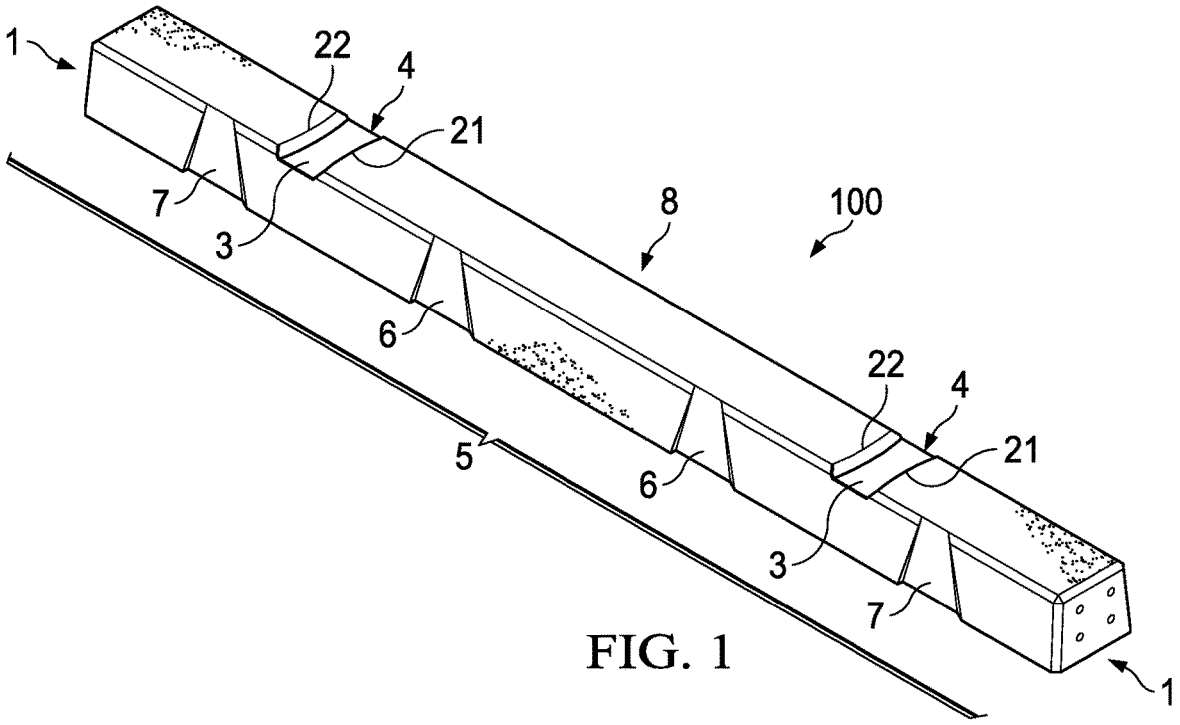
FIG. 1 is an isometric view of a monoblock, high yield, pre-stressed concrete crosstie having rail seats with a structural configuration that when mated with compatible rails fastening systems better distribute load and minimize abrasion, according to certain example embodiments.

In the description that follows, like parts are marked throughout the specification and drawings with the same reference numerals. The drawing figures might not be to scale and certain components can be shown in generalized or schematic form and identified by commercial designations in the interest of clarity and conciseness.

Due to the general trend of increasing axle loads of railroad cars, the increase in the operating speed of the trains, and the growth in cumulative gross tonnage, the need to improve existing concrete crossties (also known as ties or sleepers) for railroads has become an important priority for the railroad industry and the economic competitiveness of rail transportation. Increased performance and reduced life cycle costs of concrete ties are necessary for building durable, sustainable railways, as performance and load demands on the track increase.

The present disclosure relates to a pre-stressed concrete monoblock crosstie for ballasted railways that is able to withstand the mechanical stresses caused by the loads transmitted to it by railway traffic.

The crosstie has an optimized pre-stressed steel structure with a configuration that allows it to resist loads efficiently and sustainably. The steel structure, specifically the steel wires, can be subjected to a tensile force before the casting process. After casting and curing, the wires can be released from the tensioning mold so as to transfer a compression force to the concrete that forms the crosstie. This force produces a compressive stress that is transferred to the concrete monoblock crosstie and has the function of balancing out the tensile stress that the concrete crosstie will otherwise have to bear when a bending load is applied. When pre-stressed steel is used, the adherence of the steel to the concrete increases gradually from the ends of the element to the center to achieve a maximum adherence only after a certain distance, an effect known as transfer length. The crosstie has a steel structure such that maximum adherence along the entire length of the steel wires is achieved within a negligible transfer length. This steel structure interacts with the crosstie's concrete, which is made of only one piece of concrete that is cast and cured all at once with no construction joints, hence being a monoblock. Together, these features allow the element to function as a beam that is capable of supporting axial, bending and torsion loads, which provides many competitive advantages over other crossties, including disruptive attributes of maximum reliability and performance. The crosstie configuration at its upper surface complies with the international standards for railroad track design and can adapt to the specific needs of various rail fastening systems that may be composed of pieces embedded in the concrete and fixed components on the outside. The crosstie configuration and rail fastening system work synergistically to diffuse distribution of forces along the crosstie so as to reduce concentration of stresses and abrasion.

FIG. 1 is an isometric view of a monoblock, high-yield pre-stressed concrete crosstie with a structural geometry for ballasted railways on which high performance rail fastening systems are installed, in accordance with an exemplary embodiment of the present disclosure. Crosstie 100 can be fabricated using the materials and processes disclosed herein.

Figure 2A:
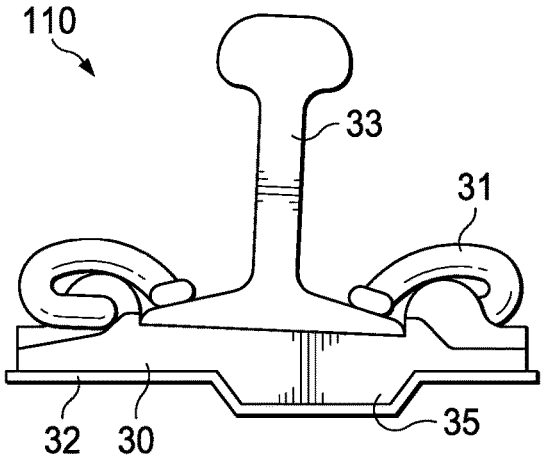
FIGS. 2A and 2B depict a front and bottom view of a rail fastening system having a tie face plate with a structural configuration compatible with the structural configuration of the rail seats, according to certain example embodiments.
Figure 2B:
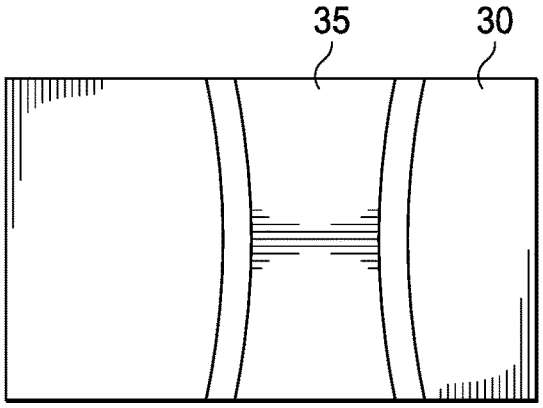

Crosstie 100 includes ends 1, which are faceted to optimize the use of material, facilitate de-molding and promote the lateral interlocking of crosstie with the ballast. The metal structure is completely contained within the element, and once the manufacturing process is complete, the tension bolts are removed and the lateral orifices resulting from the removal of the bolts may or may not be sealed with low shrinkage concrete. This design protects the steel from corrosion and oxidation. On the sides of the upper surface, rail seats 3 can have a trapezoidal shape with hourglass form or, i.e., an embedded channel 4 with a concave shape and chamfers 21 and 22 formed therein. The channel 4 allows for the reception of rail fastening system 110 that includes a base structure with a protruding element for mating the protruding element with rail seat 3, see FIGS. 2A and 2B.

Figure 3A:
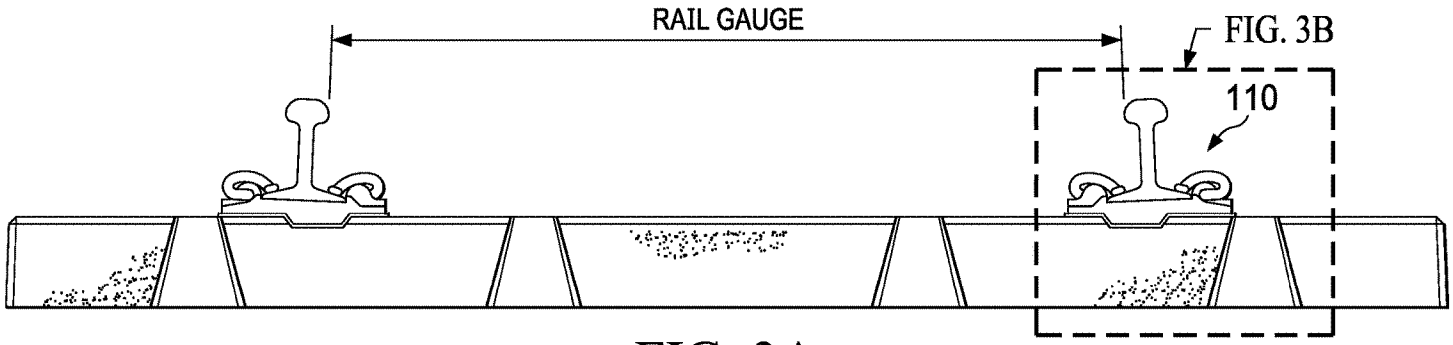
FIGS. 3A and 3B depict a side view of the concrete crosstie with rails seats and rail fastening system, according to certain example embodiments.
Figure 3B:
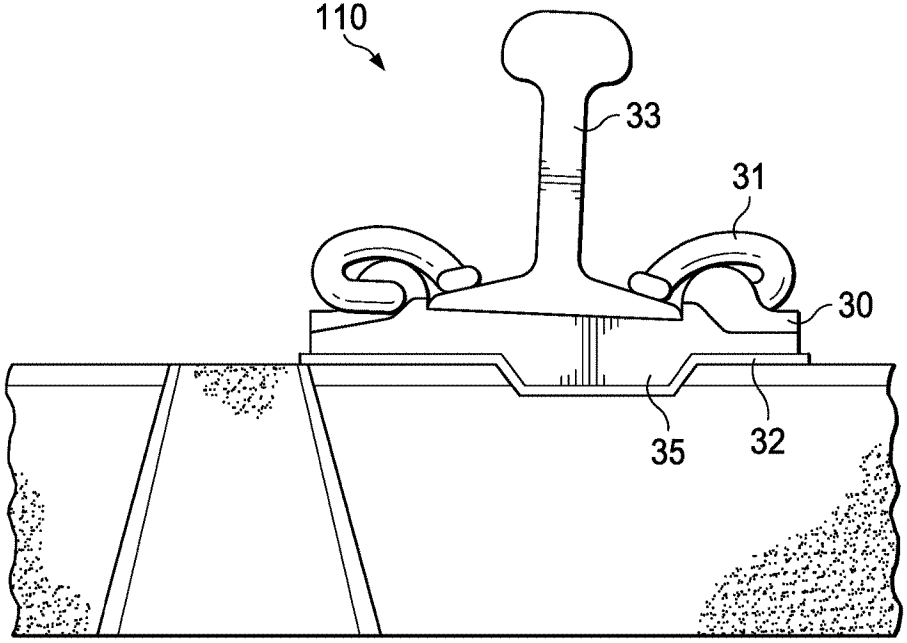

Rail fastening system 110 includes tie face plate 30, fastener 31, and a tie pad 32. The rail fastening system 110 can be used to clamp a rail 33 to fastening system 110 which in turn can be coupled with concrete crosstie 100, see FIGS. 3A and 3B. The face plate 30 can be designed to include a side for receiving the rail 33, a side that can be coupled with crosstie 100, and a protruding element 35 formed thereon that is mateable with the rail seat 3, see FIGS. 2A and 2B. The rail seats 3 have a width less than the width of the faceplate 30 and of approximate or same width as the protruding element 35. In addition, a center of the face plate 30 has a first distance from a center of the concrete element and a center of the rails seat 3 has a second distance from the center of the concrete element, the first distance greater than the second distance. However, the center of the protruding element 35 and its distance to the center of the crosstie is the same or approximately the same as that of the rail seat 3. In addition, the rail fastening system 110, e.g. when coupled with the crosstie 100, has a negative lateral tilt from the 90 degree point of the perpendicular plane, as illustrated in FIG. 3, as the plane relates to a rotational axle of a train moving across the rail 33. The negative lateral tilt counters the effects of lateral force as service loads traverse the rail fastening system 110 and rail 32 and, therefore, acts to better distribute bending force of the load across the crosstie 100. This also helps reduce abrasion on the rail seats 3 by lowering contact stresses.

Along the lateral surfaces of the crosstie, central wedges 6 and end wedges 7 are incorporated into the design in order to ensure interlocking with the ballast. Although FIG. 1 illustrates the application of 2 central wedges, additional wedges can be used along the center.

Figure 4:
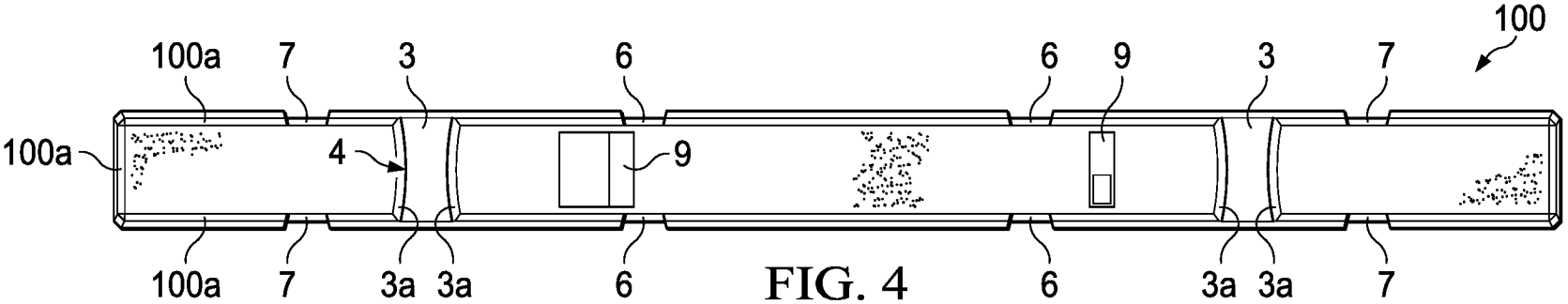
FIG. 4 depicts a top view of the crosstie that illustrates designs and configurations of the crosstie, rail seats, and lateral wedges, according to certain example embodiments.

FIG. 4 shows a top view of crosstie 100, in accordance with an exemplary embodiment of the present disclosure. Rail seats 3 form a convex channel 4 on the top of the crosstie 100 in a manner responding to the design load requirements in the critical regions of the crosstie while the steel structure maintains its uniform design. The rails seats 3 are formed during manufacture along the top of the crosstie 100. The rail seats 3 can be formed along the top to accommodate a particular rail gauge. The rails seats 3 can also include chamfered edges along the sides 100*a* of the crosstie 100 and along the sides 3*a* of the channel 4. The wedges 6, 7 are formed, also during the pre-stress manufacturing phase, across the sides of the crosstie 100. The wedges 6, 7 can also include chamfered edges. Crosstie 100 includes an embossed nomenclature 9 including: customer name, mold and sub-mold used, the crosstie model, the rail fastening system to be used and the date of manufacture.

Figure 5:
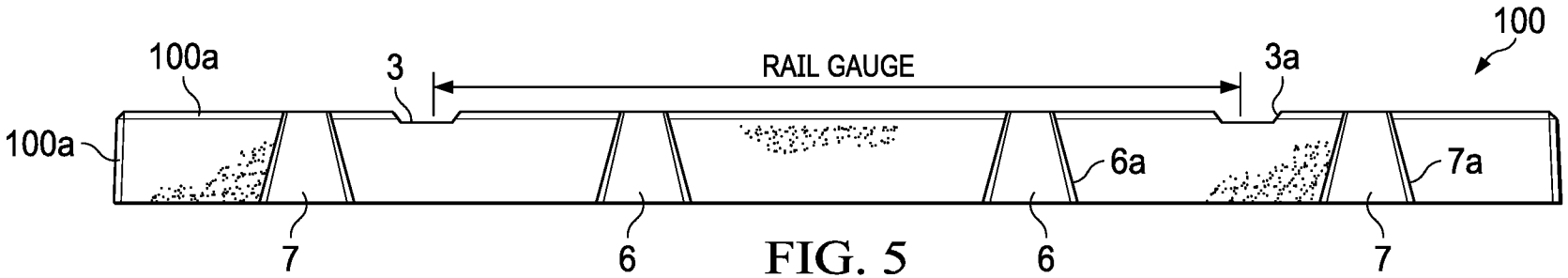
FIG. 5 depicts a side view of the crosstie that illustrates designs and configurations of the crosstie, rail seats, and lateral wedges, according to certain example embodiments.

FIG. 5 shows a side view of crosstie 100, in accordance with an exemplary embodiment of the present disclosure. The crosstie 100 includes chamfered sides 100*a* around the periphery of crosstie 100 and along the sides 3*a* of the channel 4 and also along the sides 6*a*, 7*a* of the central and outer wedges 6, 7. Example dimensions of crosstie 100 could be:

| | |
|---|---|
| Rail Gauge | 56½ inches |
| Narrow section of concave channel | 2⅞ inches |
| Wide section of concave channel | 3⅝ inches |
| Depth of the concave channel | ¾ inches |
| Chamfers (all) | ½ to 9/16 of an inch |
| Width of base of the outer and center wedge | 6 11/16 inches |
| Width of narrow end of the outer and center wedge | 3¼ inches |
| Distance between edge of concave channel chamfer and beginning of chamfer of outer wedge | 4 7/16 inches |
| Distance between end of crosstie 100 and base of outer wedge | 10¼ inches |
| Distance between end of crosstie 100 and narrow end of outer wedge | 11¾ inches |
| Distance between chamfer of base of outer wedge to chamfer of base of center wedge | 17 1/16 inches |
| Distance between chamfer of concave channel and narrow end of center wedge | 11 5/16 inches |
| Distance between chamfers at narrow end of center wedges | 24 inches |
| Distance between chamfers at base of center wedges | 20 9/16 inches |
| Depth of wedges | ½ inch |
| Total length of crosstie | 102 inches |
| Height of crosstie | 6⅜ inches |
| Width of crosstie (bottom) | 8¼ inches |
| Width of the crosstie (top - rail facing) | 6¾ inches (top of chamfer) and 7¼ inches (bottom of chamfer) |

It should be understood that these measurements can be considered examples of a certain embodiment and approximations.

Figure 6:
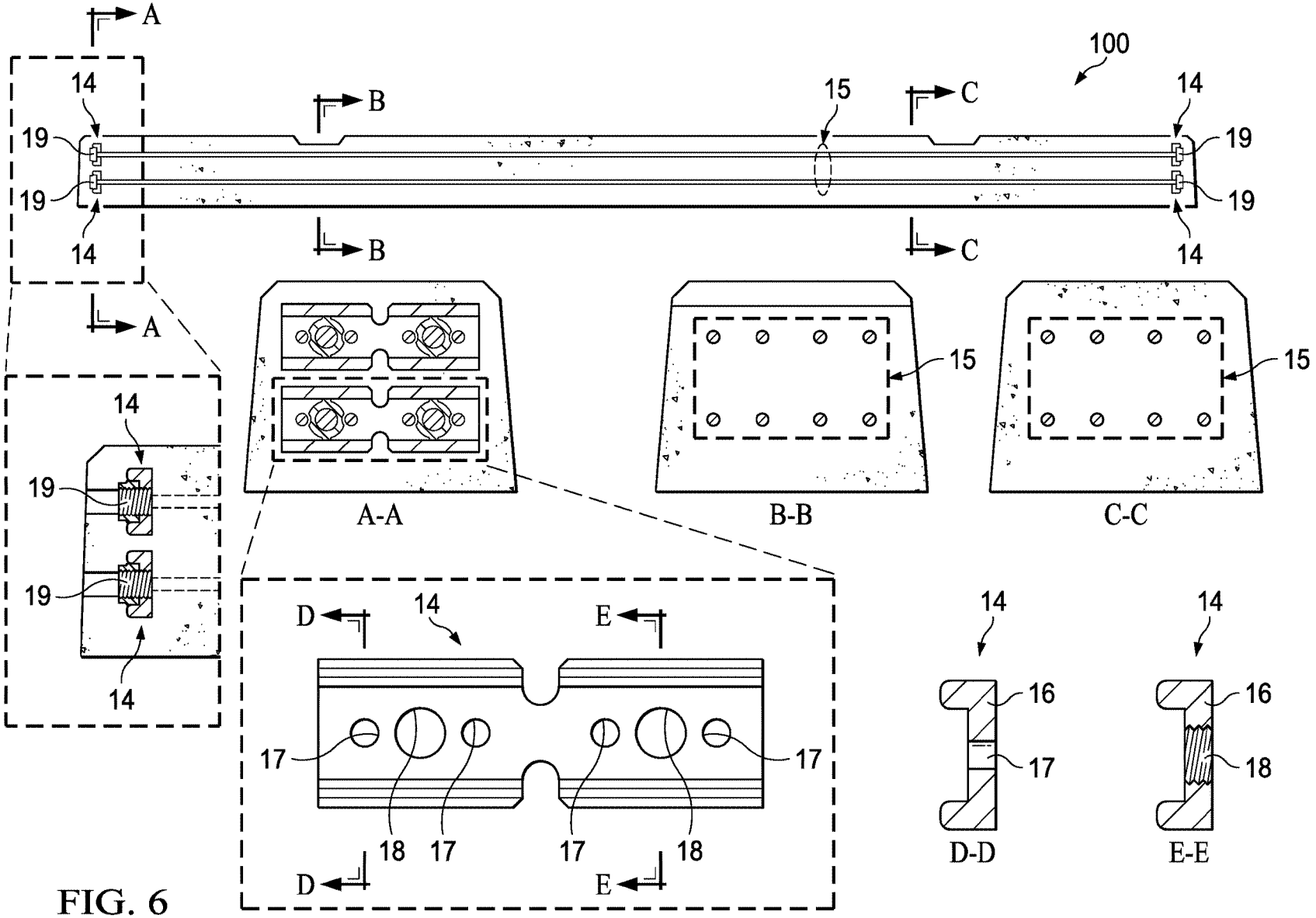
FIG. 6 depicts a diagram of three longitudinal sections that show the arrangement of the steel structure and the clamping plates at the end of the crosstie, according to certain example embodiments.

FIG. 6 is a diagram of three longitudinal sections that show the arrangement of the steel structure and the clamping plates at the end of crosstie 100, in accordance with an exemplary embodiment of the present disclosure. Section A-A shows the metallic structure where the fixing plates of the metal structure are located. Section B-B shows the center of the rail seat where the rail fastening system is located and transmits the forces of the passing trains to the crosstie. Section C-C shows the disposition of the steel structure within the crosstie along the center section, which in the embodiment the sections of the element have similar dimensions.

Clamping anchor plates 14 are made of high strength steel and are placed at the ends of crosstie 100 to allow pre-stressed wire 15 to acquire the required compression in the concrete. The pre-stressed clamping plates are made of ultra-high strength steel having dimensions of 6 inches long, e.g., with a bend 16 at the top and bottom areas at an angle close to 0°. In other words, the clamping plates essentially form a U-shape. These plates have four round holes 17 of at least ⅓ inches in diameter and two piercings 18, which allow the passage of tensioning bolts of a minimum diameter of 11/16 inches. The pre-stressed wires 15 are formed of cold rolled steel with a diameter of at least ⅓ inches and the group is composed of at least eight wires. The dimensions of the clamping plates 14 and pre-stressed wires 15 in relation with the crosstie 100 can be:

| | |
|---|---|
| Bottom of crosstie to center of bottom clamp (vertical) | 2 3/16 inches |
| Top of crosstie to center of top clamp (vertical) | 1 11/16 inches |
| Between center of bottom clamp to center of top clamp (vertical) | 2½ inches |
| Length of U-Clamp 14 | 6 inches |
| Distance between piercings 18 of U-clamp | 3¼ inches |
| Distance between holes 17 | 1½ to 1¾ inches |

It should be understood that these measurements can be considered examples of a certain embodiment and approximations. The pre-stressed wires are formed of cold rolled steel with a diameter of ¼ inches (range of variability±3/32 inches) and the group is composed of at least eight wires. These wires are arranged longitudinally and if seen from a cross section they are placed on a grid of three vertical levels and has at least two wires per level. The pre-stressed steel is tensioned to at least 70% (seventy percent) of its capacity. To achieve the tie-up of the wire to the anchor plate, button head knots 19, which hold themselves to the circular perforations of the plate, are used. The function of the button head is to secure and support the forces exerted by the pre-stressed wires on the anchor plate. Button head knots 19 of the pre-stressed wires have a diameter of at least 40% (forty percent) wider than the wire itself. The two holes for the locking of the tensing bolts allow the clamping of the anchor plate to exert a tensile force to the wires pre-stressing them during the manufacturing process, this force is maintained until the concrete has cured and afterwards, the bolts are removed.

Figure 7:
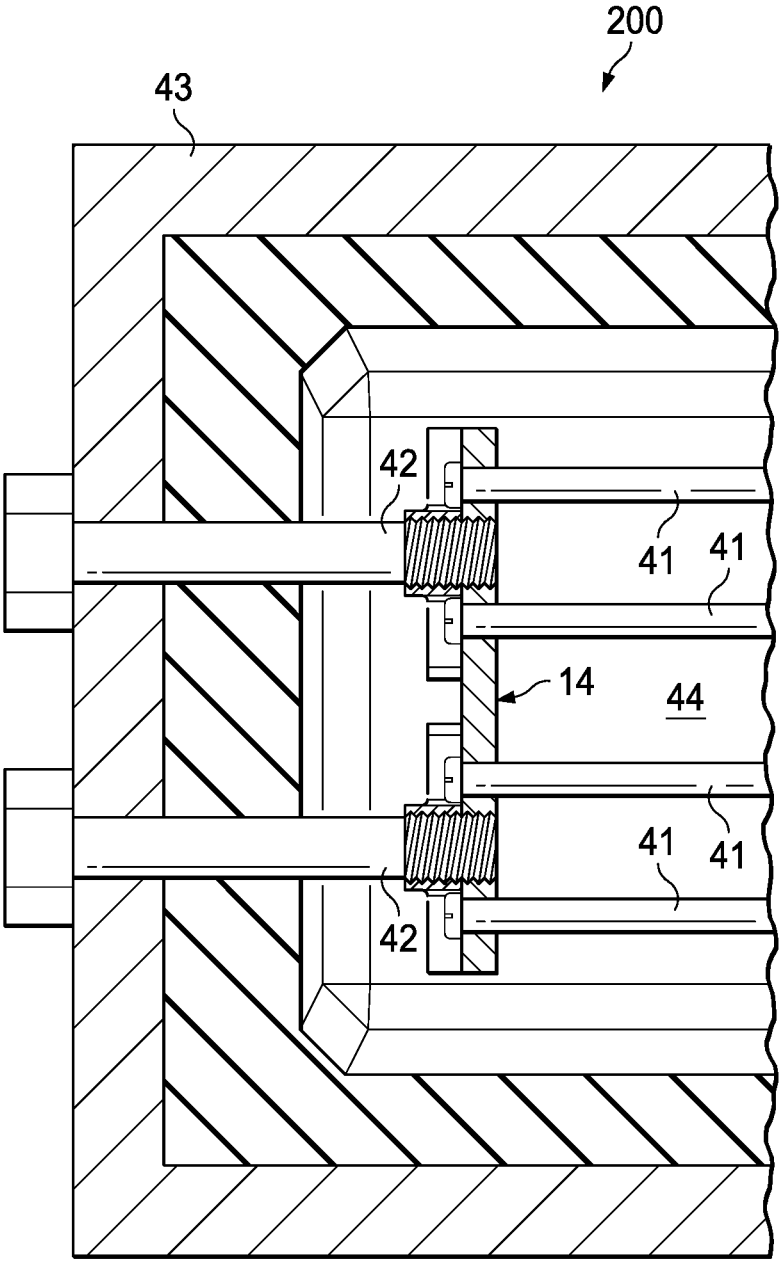
FIG. 7 depicts a top cut-away view of a crosstie cast mold and tensioning apparatus, according to certain example embodiments.

FIG. 7 is a top and half sectional view of an assembly 200 for manufacturing crosstie 100, according to certain example embodiments. The internal steel structure is formed by two threaded plates 14 at a first end and two threaded plates 14 at a second end, see FIGS. 6 and 7. Each of the first threaded plates are coupled to one of the second threaded plates by a plurality of tensioning wires 41, see FIG. 5.

The threaded plates 14 can be "U" shaped, where the U channel extends towards the center of the tie in the direction of the tensioning cables. This allows the end plates to apply a better distribution of force as compared to other configurations of the end plate. The upper and lower "U" shaped cut-outs in the U-shaped end plates at the centerline of the end plate 14, as seen in section A-A, provide flexibility between the two halves of the end plate, and facilitate the distribution of forces when the wires 41 are placed under tension. A steel rod 42 can be inserted into the threaded center holes/spindle holes (which eliminate the need for a bolt or nut to secure the structure to the end plate) and attached to a tensioning apparatus 43. When tensioning apparatus 43 is used to apply a tension to the tensioning cables, the "U" shaped cut-outs allow the tensioning cables to be more evenly tensioned and increase the bending strength of the end plate. Concrete is then poured into the mold 44, and the crosstie 100 can set with the tensioning wires 41 under tension. The end plates 14 cannot exceed the compressive strength of the concrete, which is typically limited to 0.6 times the design or expected compressive failure strength of the concrete. The wires 41 are arranged longitudinally and tensioned to at least 70% of its capacity. To achieve the tie-up of the wire to the anchor plate 14, button head knots 19, which hold themselves to the circular perforations of the plate, are used. The function of the button head is to secure and support the forces exerted by the pre-stressed wires 15 on the anchor plate 14. Button head knots 19 of the pre-stressed wires 15 have a diameter of at least 40% (forty percent) wider than the wire itself. The crosstie 100 is made from high performance and air entrained concrete with a low w/c ratio. The crosstie has a field compressive strength of at least 10,000 psi and a 28 day compressive strength.

The disclosure thus provides 1) a steel structure composed of anchoring plates at the crosstie's ends and pre-stressed wires that run longitudinally from one end to the other, 2) the use of high performance steel and concrete and their design that form a monoblock crosstie element with high performance rail seats and rail fastening systems that can tolerate heavy loads, and 3) a faceted geometry that promotes crosstie-ballast interlocking and the elements stability. The steel structure includes a set of cold drawn steel pre-stressed wires organized in a reticular grid. The wires extend longitudinally along the crosstie and are fastened to each end of the crosstie with a number of anchoring plates made of high yield-strength steel of a minimum tensile strength of 110 kilo pounds per square inch (ksi) derived from the cold forming of hot rolled steel strips. The ends of the wires are topped with button head type knots to provide adequate interlock with the anchor plates.

The plates and the wires work together. The plates compress the concrete from end to end and the wires adhere to the concrete all along their length, the structure transfers all loads to the concrete along its entire length, which in turn allows the design of a shorter monoblock crosstie. The interaction of the steel structure and the high strength concrete allows the crosstie to function integrally improving its performance and lifespan.

The design load on each axle is 41 tons (US) or more and crosstie is 8 feet and 6 inches long or less. The geometry of crosstie 100 can meet the specifications required to fulfil its functions and meet the load and strength requirements. The geometric outline of the rail seats and face plates are designed according to the different needs of the crosstie, but its form remains aesthetically attractive and has a unique identity. The geometry also provides increased stability and interlocking with the ballast. The lateral wedges of which the crosstie is provided allow the ballast to find a place in these slots to prevent movement. The trapezoidal and concave shapes of the rail seats also play a role in unifying the ballast-crosstie system due to the fact that they limit the movement of the ballast and partially confine it to the center of the sides of the concrete crosstie. This configuration causes the ballast to remain in place and in turn the latter favors the crosstie by holding it in position. In the crosstie ends, a multifaceted form with additional wedges has been provided. The end designs allows the allocation of the ballast gravel in positions that maximize its efficiency to stabilize the element. Chamfers and fillets are added to crosstie 100, which, together with the general geometry, reduce the amount of angles that are greater than ninety degrees, to diminish chipping and cracks in the concrete. The element results in a robust monoblock concrete crosstie that works efficiently to allow the safe transit of trains.

By bringing together innovative features into the crosstie's design as its pre-stressed steel structure, high strength concrete and rail seat and rail system design, it can be said that the efficiency achieved in respect to its functionality and performance is unprecedented in the rail industry.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A monoblock pre-stressed concrete crosstie for use in ballasted railways comprising:

an elongated concrete element having a longitudinal axis;

an internal steel structure of the concrete element comprising one or more reinforced steel plates, each having a first tensioning structure configured for connection to an external tensioning device and a second tensioning structure coupled to a steel element that is internal to the crosstie, and a system of reinforced, u-shaped plates and pre-stressed wires embedded in high strength concrete capable of supporting a minimum axle load of 41 tons (US), and where the crosstie has a maximum length of 8 feet and 6 inches;

a rail seat of the concrete element; and a face plate assembly having an extending member and the extending member mateable with the rail seat;

wherein the railseat has a width less than the width of the faceplate, and a center of the face plate has a first distance from a center of the concrete element and a center of the rails seat has a second distance from the center of the concrete element, the first distance greater than the second distance.

2. The crosstie of claim 1 wherein the concrete element has a first horizontal plane parallel to the longitudinal axis of the element and the face plate assembly has a second horizontal plane wherein the second horizontal plane is at an angle greater than zero to the longitudinal axis.

3. The crosstie of claim 2 wherein the face plate assembly further includes a rubber gasket interfaced between the fastener plate and clip and the crosstie.

4. The crosstie of claim 1 wherein the face plate assembly has an angle of inclination of less than 90 degrees.

5. The crosstie of claim 1 wherein the rail seat and the extending member have a convex shape with chamfered edges.

6. The crosstie of claim 1 wherein the internal steel structure is formed by two or more first u-shaped plates at a first end and two or more second u-shaped plates at a second end, each of the first u-shaped plates coupled to one of the second plates by a plurality of pre-stressed wires, wherein each wire is tensioned to at least 70% (seventy percent) of its elastic capacity, wherein the plurality of pre-stressed wires are arranged in parallel, and wherein each of the plurality of pre-stressed wires is secured to one or more of the plates by pressed button head type knots located at the wire ends.

7. The crosstie of claim 1 wherein the internal steel structure is formed by two or more plates at each end, wherein the plates of the internal steel structure are embedded in the concrete and apply a compressive force to the concrete, and a plurality of pre-stressed wires that work by adherence to transfer a load to the concrete.

8. The crosstie of claim 1 wherein the reinforced steel plates comprise two or more plates at each end that are configured to apply a compressive force to the concrete.

9. The crosstie of claim 1 wherein the internal steel structure comprises reinforced steel plates comprise a system of plates and pre-stressed wires embedded in high strength concrete.

10. The crosstie of claim 1 wherein the reinforced steel plates comprise two or more first plates at a first end and two or more second plates at a second end.

11. The crosstie of claim 10 wherein each of the first plates coupled to one of the second plates by a plurality of pre-stressed wires.

12. The crosstie of claim 11 wherein each wire is tensioned to at least 70% of its elastic capacity.

13. The crosstie of claim 12 wherein the plurality of pre-stressed wires are arranged in parallel.

14. The crosstie of claim 11 wherein each of the plurality of pre-stressed wires is secured to one or more of the plates.

15. The crosstie of claim 1 wherein the concrete element further comprises at least one lateral wedge on each end and at least two wedges between rails seats.

16. A monoblock pre-stressed concrete crosstie for use in ballasted railways comprising:

an elongated concrete element having a longitudinal axis;

an internal steel structure of the concrete element comprising one or more reinforced steel plates, each having a first tensioning structure configured for connection to an external tensioning device and a second tensioning structure coupled to a steel element that is internal to the crosstie, wherein the internal steel structure is formed by two or more first u-shaped plates at a first end and two or more second u-shaped plates at a second end, each of the first u-shaped plates coupled to one of the second plates by a plurality of pre-stressed wires, wherein each wire is tensioned to at least 70% (seventy percent) of its elastic capacity, wherein the plurality of pre-stressed wires are arranged in parallel, and wherein each of the plurality of pre-stressed wires is secured to one or more of the plates by pressed button head type knots located at the wire ends;

a rail seat of the concrete element; and a face plate assembly having an extending member and the extending member mateable with the rail seat;

wherein the railseat has a width less than the width of the faceplate, and a center of the face plate has a first distance from a center of the concrete element and a center of the rails seat has a second distance from the center of the concrete element, the first distance greater than the second distance.

17. The crosstie of claim 16 wherein the concrete element has a first horizontal plane parallel to the longitudinal axis of the element and the face plate assembly has a second horizontal plane wherein the second horizontal plane is at an angle greater than zero to the longitudinal axis.

18. The crosstie of claim 16 wherein the face plate assembly has an angle of inclination of less than 90 degrees.

19. The crosstie of claim 16 wherein the rail seat and the extending member have a convex shape with chamfered edges.

20. The crosstie of claim 16 wherein the concrete element further comprises at least one lateral wedge on each end and at least two wedges between rails seats.

* * * * *